US008109459B2

(12) United States Patent
Nissen et al.

(10) Patent No.: US 8,109,459 B2
(45) Date of Patent: Feb. 7, 2012

(54) ROLLER MILL

(75) Inventors: Rasmus Thranberg Nissen, Copenhagen (DK); Morten Larsen, Greve (DK)

(73) Assignee: FLSmidth A/S, Valby (DK)

( * ) Notice: Subject to any disclaimer, the term of this patent is extended or adjusted under 35 U.S.C. 154(b) by 64 days.

(21) Appl. No.: 12/682,932

(22) PCT Filed: Oct. 13, 2008

(86) PCT No.: PCT/EP2008/063720

§ 371 (c)(1),
(2), (4) Date: Apr. 14, 2010

(87) PCT Pub. No.: WO2009/050142

PCT Pub. Date: Apr. 23, 2009

(65) Prior Publication Data

US 2010/0219276 A1 Sep. 2, 2010

(30) Foreign Application Priority Data

Oct. 16, 2007 (DK) ..... PA 2007 01486

(51) Int. Cl.
*B02C 15/00* (2006.01)

(52) U.S. Cl. ..... 241/120

(58) Field of Classification Search ..... 241/117–121
See application file for complete search history.

(56) References Cited

U.S. PATENT DOCUMENTS 3,658,264 A * 4/1972 Schauer ..... 241/121
7,472,853 B2 * 1/2009 Petersen ..... 241/19

FOREIGN PATENT DOCUMENTS

DE 103 05 915 8/2004
FR 485 149 12/1917
GB 601 299 5/1948

OTHER PUBLICATIONS

International Search Report, dated Dec. 22, 2008 (2 pages).

* cited by examiner

*Primary Examiner* — Mark Rosenbaum
(74) *Attorney, Agent, or Firm* — Buchanan Ingersoll & Rooney PC

(57) ABSTRACT

A roller mill for grinding particulate material, such as cement raw materials, cement clinker and similar materials has a rotatable grinding table with a substantially vertical centerline and a number of rollers being configured for interactive operation with the grinding table and turning about separate roller shafts which are fixed to a rotatable center shaft with a substantially vertical centerline. The center shaft and the grinding table are fixed one to the rotor and the other to the stator of the same motor, which may have the capability of rotating both the grinding table and the center shaft.

17 Claims, 1 Drawing Sheet

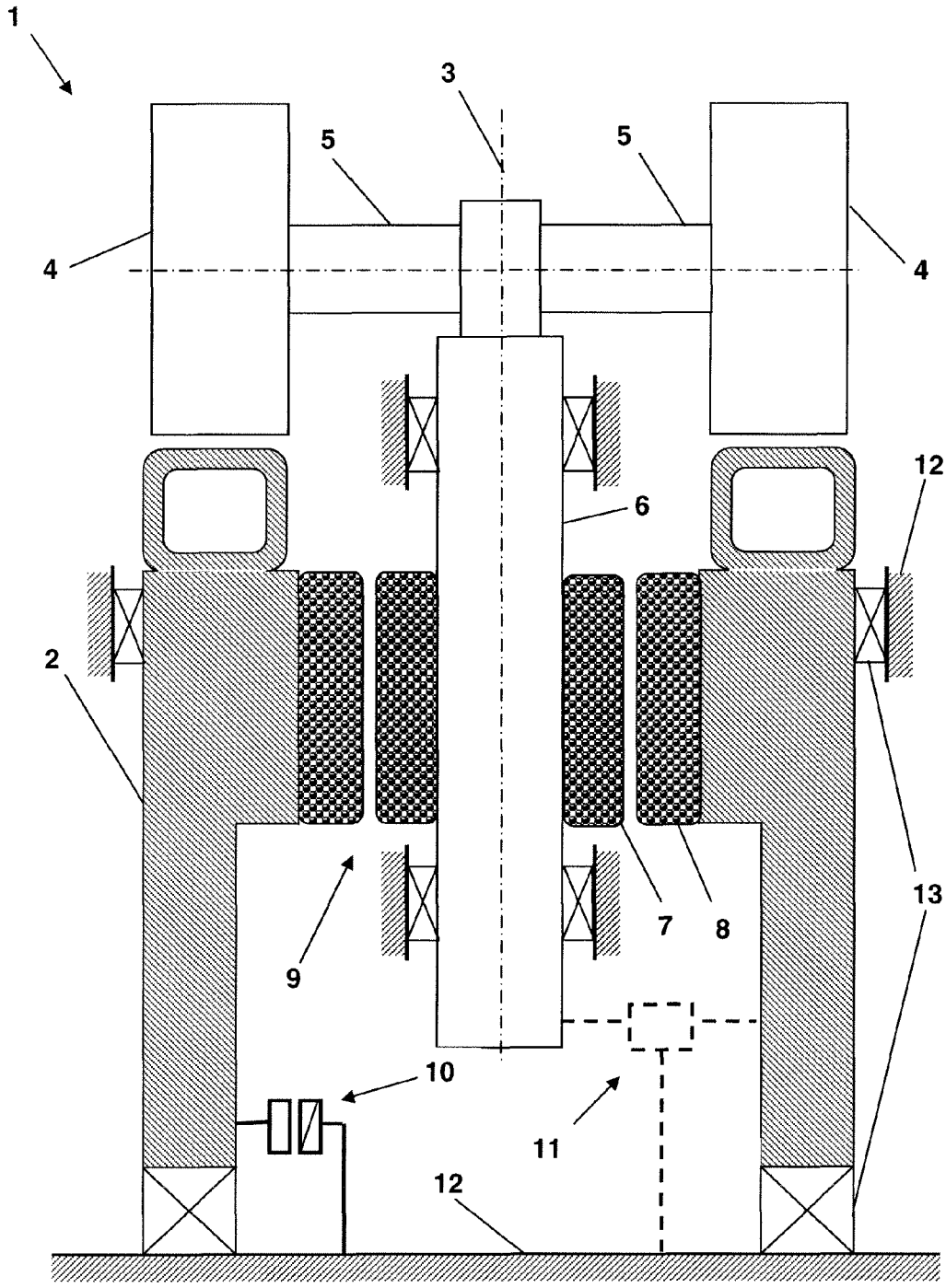
1
3
5
5
4
4
12
6
2
13
7
8
9
10
11
12

ROLLER MILL

CROSS-REFERENCE TO RELATED APPLICATIONS

This application is the United States national stage under 35 U.S.C. §371 of International Application No. PCT/EP2008/063720, filed on Oct. 13, 2008, claiming priority to Danish Application No. PA 2007 01486, filed on Oct. 16, 2007. Both of those applications are incorporated by reference herein.

FIELD OF THE INVENTION

The present invention relates to a roller mill for grinding particulate material, such as cement raw materials, cement clinker and similar materials.

BACKGROUND OF THE INVENTION

Roller mills generally comprise a rotatable grinding table with a substantially vertical centerline and a number of rollers configured for interactive operation with the grinding table and turning about separate roller shafts which hare fixed to a rotatable center shaft which also has a substantially vertical centerline.

A roller mill of the aforementioned kind is known from GB 601 299 A. This known roller mill incorporates a drive unit and a gearing mechanism between a rotatable grinding table and a rotatable center shaft. However, the use of a gearing mechanism results in an energy loss due to the mechanical efficiency of (frictional losses within) the gearing mechanism. Futhermore, gearing mechanisms for roller mills are generally subject to severe load conditions and will normally need replacing several times during the lifetime of a roller mill. Moreover, a disadvantage of the mentioned gearing mechanism is that it is not possible to adjust the relative speeds of the grinding table and the rotatable center shaft so that, for example, the grinding table rotates relatively fast and the rotatable center shaft carrying the rollers relatively slow.

SUMMARY OF THE INVENTION

It is an objective of the present invention to provide a roller mill by means of which the aforementioned disadvantages are reduced or eliminated.

This is achieved by a roller mill of the kind described in the introduction and characterized in that the center shaft and the grinding table are driven by an connected one to the rotor and the other to the stator of the same electric motor.

As both the rotor and the stator are actually able to rotate relative to a fixed point, the terms rotor and stator refer to inner and outer relatively rotatable parts of the motor and the terms 'rotor' and 'stator' are used for convenience.

By this means, a single electric motor has the capability of rotating the grinding table as well as the rotatable center shaft carrying the rollers. This is achieved by configuring the electric motor so that the rotor as well as the stator will be capable of rotation. Hence, according to the present invention, the stator will not be stationary, but rotating, and, therefore, the stator must be furnished with means such as collector rings and brushes for transmitting electrical energy and bearings for supporting the rotation must be mounted in the machine frame. Using an electric motor in this manner eliminates the need for a gearing mechanism between the electric motor and the grinding table and the center shaft, respectively.

In order to control the speed between the grinding table and the center shaft, it is desirable to include means which are capable of doing this. The means may in principle be constituted by any suitable means as long as they are capable of controlling the speed of the grinding table relative to the machine frame.

In one embodiment the means may comprise an electric motor with adjustable speed which is connected to a stationary point, such as the machine frame, and the grinding table. In this way, the speed of the grinding table is locked to the machine frame, whereby it is possible to freely choose the relationship between the speed of the grinding table and the speed of the center shaft by adjusting the motor frequency. The motor controls the speed of the table (it does not rotate it) and by lowering the speed of the table the speed of the center shaft will automatically be increased and vice versa.

In another embodiment the means may comprise a planetary gear wheel connected both to the grinding table and the center shaft. The planetary gear wheel is rotatably mounted on a protruding part of the machine frame. In this case the relationship between the speed of the grinding table and the speed of the center shaft is given by the numbers of teeth of the gear wheels. this gear only has to transmit the bearing friction.

In a third embodiment the means may comprise a brake, such as a hydraulic brake or an eddy-current brake, connected to the grinding table or the center shaft and a stationary point. In this way it is possible to control the relative speed between the grinding table and the center shaft.

There are several advantages associated with using one and the same electric motor for operating the grinding table as well as the center shaft instead of using, for example, two electric motors, the rotors of which being fixed to the grinding table and the center shaft, respectively. Among other things, a roller mill design with just one electric motor will be more compact and will contain fewer components requiring maintenance.

BRIEF DESCRIPTION OF THE FIGURE

An embodiment of the invention will now be described in further detail with reference to the accompanying diagrammatic drawing showing a sectional view of a roller mill in accordance with the invention.

DETAILED DESCRIPTION OF PRESENT PREFERRED EMBODIMENTS

In the FIGURE, a roller mill 1 is shown which comprises an annular and rotatable grinding table 2 and a number or rollers 4 which are configured for interactive operation with the grinding table 2. The rollers 4 rotate about separate roller shafts 5 each of which is connected to a rotatable center shaft 6 which has a substantially vertical centerline 3. The center shaft 6 is fixed to the rotor 7 of an electric motor 9 and the grinding table 2 is fixed to the stator 8 of the electric motor 9. Bearings 13 supporting the grinding table 2 are mounted in the machine frame 12 in order to allow the stator to rotate.

Preferably, the electric motor 9 is an asynchronous or a synchronous motor.

The electric motor 9 may have the capability to rotate the grinding table 2 as well as the center shaft 6. A small electric motor 10 with adjustable speed is connected to the grinding table 2 and the machine frame 12 and is used to control the relative speed between the grinding table 2 and the machine frame 12.

Another mechanism for controlling the relative speed between the grinding table 2 and the center shaft 6 is shown in dotted lines. A planetary gear 11 may be connected both to the grinding table 2 and to the center shaft 6. The planetary gear may include a wheel that is rotatably mounted in a protruding part of the machine frame 12.

While certain present preferred embodiments of the roller mill and certain embodiments of methods of practicing the same have been shown and described, it is to be distinctly understood that the invention is not limited thereto but may be otherwise variously embodied and practiced within the scope of the following claims.

The invention claimed is:

1. A roller mill for grinding particulate material comprising:

a rotatable grinding table having a substantially vertical centerline;

a number of rollers configured for interactive operation with the grinding table, each roller rotating about a respective roller shaft; each roller shaft attached to a rotatable center shaft, the center shaft having; a substantially vertical centerline;

a motor comprising a rotor and a stator; and one of the rotor and the stator being connected to the center shaft and the other of the rotor and the stator being connected to the grinding table, the motor driving rotation of the table and rotation of the center shaft.

2. A roller mill according to claim 1, further comprising means for controlling a speed between the grinding table and the center shaft.

3. A roller mill according to claim 2 wherein the means for controlling the speed between the grinding table and the center shaft comprises an electric motor with adjustable speed which is connected to the grinding table and a stationary point.

4. A roller mill according to claim 2 wherein the means for controlling the speed between the grinding table and the center shaft comprises a planetary gear connected both to the grinding table and the center shaft, the planetary gear being rotatably mounted on a stationary point.

5. A roller mill according to claim 2 wherein the means for controlling the speed between the grinding table and the center shaft comprise a brake connected between a stationary point and the grinding table or the center shaft.

6. The roller mill of claim 1 further comprising a planetary gear connected to the grinding table and the center shaft, the planetary gear being rotatably mounted on a stationary point, the planetary gear having teeth that that define a speed ratio between the grinding table and the center shaft.

7. The roller mill of claim 6 wherein the planetary gear is sized and configured to only transmit bearing friction.

8. The roller mill of claim 7 further comprising a machine frame, the stationary point being a portion of the machine frame.

9. The roller mill of claim 1 further comprising a brake connected to the grinding table or the center shaft, the brake also connected to a stationary point, the brake configured to control a speed ratio between the grinding table and the center shaft.

10. The roller mill of claim 9 wherein the brake is an eddy-current brake or a hydraulic brake.

11. The roller mill of claim 1 wherein the motor is an asynchronous electric motor or a synchronous electric motor.

12. A roller mill comprising:

a plurality of rollers;

a plurality of rotating shafts, each of the rotating shafts connected to a respective roller of the plurality of rollers;

a center shaft, the center shaft attached to each of the rotating shafts of the plurality of rotating shafts;

a grinding table adjacent to the rollers;

a motor having a rotor and a stator, the motor configured to drive rotation of the rollers and the center shaft, the rotor attached to the center shaft and the stator attached to the grinding table or the stator attached to the center shaft and the rotor attached to the grinding table.

13. The roller mill of claim 12 further comprising a planetary gear connected to the grinding table and the center shaft, the planetary gear being rotatably mounted on a stationary point, the planetary gear having teeth that that define a speed ratio between the grinding table and the center shaft.

14. The roller mill of claim 13 wherein the planetary gear is sized and configured to only transmit bearing friction.

15. The roller mill of claim 13 further comprising a machine frame, the stationary point being a portion of the machine frame.

16. The roller mill of claim 12 further comprising a brake connected to the grinding table or the center shaft, the brake also connected to a stationary point, the brake configured to control a speed ratio between the grinding table and the center shaft.

17. The roller mill of claim 16 wherein the brake is an eddy-current brake or a hydraulic brake.

* * * * *